US010351978B2

(12) United States Patent
Spielmann et al.

(10) Patent No.: US 10,351,978 B2
(45) Date of Patent: Jul. 16, 2019

(54) METHOD FOR KNITTING A FOOTWEAR ELEMENT AND FOOTWEAR ELEMENT OBTAINED BY SUCH A METHOD

(71) Applicants: Anton Percy Spielmann, Collonge-Bellerive (CH); William Steven Spielmann, Collonge-Bellerive (CH)

(72) Inventors: Anton Percy Spielmann, Collonge-Bellerive (CH); William Steven Spielmann, Collonge-Bellerive (CH)

( * ) Notice: Subject to any disclaimer, the term of this patent is extended or adjusted under 35 U.S.C. 154(b) by 745 days.

(21) Appl. No.: 14/770,265

(22) PCT Filed: Feb. 25, 2014

(86) PCT No.: PCT/EP2014/053641

§ 371 (c)(1),
(2) Date: Aug. 25, 2015

(87) PCT Pub. No.: WO2014/131762

PCT Pub. Date: Sep. 4, 2014

(65) Prior Publication Data

US 2016/0000173 A1 Jan. 7, 2016

(30) Foreign Application Priority Data

Feb. 26, 2013 (FR) ..... 13 51704

(51) Int. Cl.
*D04B 1/24* (2006.01)
*D04B 1/22* (2006.01)
(Continued)

(52) U.S. Cl.
CPC ..... *D04B 1/22* (2013.01); *A43B 1/04* (2013.01); *A43B 23/0245* (2013.01);
(Continued)

(58) Field of Classification Search
CPC ..... D04B 1/22; D04B 1/24; A43B 1/04
See application file for complete search history.

(56) References Cited

U.S. PATENT DOCUMENTS 1,888,172 A * 11/1932 Joha ..... A43B 1/02 36/11
1,910,251 A * 5/1933 Joha ..... D04B 1/24 12/142 S
(Continued)

FOREIGN PATENT DOCUMENTS

CN 1067566 A 1/1993
CN 101583294 A 11/2009
(Continued)

OTHER PUBLICATIONS

Chinese Search Report and Office Action dated Aug. 3, 2016 in corresponding Chinese application No. CN2014800105143; with English partial translation and partial machine translation (15 pages) (US20120233882 and US20120233884 cited in the Chinese Search Report are not listed in this IDS since they were cited in the ISR and listed in the IDS filed Aug. 25, 2015).
(Continued)

*Primary Examiner* — Danny Worrell
(74) *Attorney, Agent, or Firm* — Westerman, Hattori, Daniels & Adrian, LLP

(57) ABSTRACT

A method for continuously knitting a footwear element (101), in particular a shoe element (100), including a knitted upper (110), a knitted tongue (111), and a knitted sole (112).

20 Claims, 5 Drawing Sheets

(51) Int. Cl.

| | |
|---|---|
| ***A43B 23/02*** | (2006.01) |
| ***A43B 1/04*** | (2006.01) |
| ***A43B 23/04*** | (2006.01) |
| ***D04B 35/06*** | (2006.01) |
| ***D04B 1/10*** | (2006.01) |

(52) U.S. Cl.

CPC ..... *A43B 23/0265* (2013.01); *A43B 23/042* (2013.01); *D04B 1/106* (2013.01); *D04B 1/108* (2013.01); *D04B 35/06* (2013.01); *D10B 2403/0333* (2013.01); *D10B 2501/043* (2013.01)

(56) References Cited

U.S. PATENT DOCUMENTS

| | | | | |
|---|---|---|---|---|
| 5,345,638 | A | 9/1994 | Nishida | |
| 7,051,460 | B2 * | 5/2006 | Orei | A43B 1/00 36/3 A |
| 8,448,474 | B1 * | 5/2013 | Tatler | A43B 23/0245 66/64 |
| 8,973,410 | B1 * | 3/2015 | Podhajny | A43B 23/024 66/177 |
| 2004/0118018 | A1 * | 6/2004 | Dua | A43B 1/04 36/45 |
| 2005/0115284 | A1 * | 6/2005 | Dua | A43B 1/04 66/178 R |
| 2005/0193592 | A1 * | 9/2005 | Dua | A43B 1/04 36/45 |
| 2008/0110048 | A1 | 5/2008 | Dua et al. | |
| 2010/0269372 | A1 | 10/2010 | Dua et al. | |
| 2010/0281631 | A1 | 11/2010 | Dua et al. | |
| 2011/0078921 | A1 | 4/2011 | Greene et al. | |
| 2012/0233882 | A1 | 9/2012 | Huffa et al. | |
| 2012/0233884 | A1 | 9/2012 | Greene | |
| 2012/0255201 | A1 * | 10/2012 | Little | A43B 1/04 36/84 |
| 2012/0285043 | A1 | 11/2012 | Dua et al. | |
| 2013/0239438 | A1 * | 9/2013 | Dua | A43B 1/04 36/84 |
| 2013/0239625 | A1 * | 9/2013 | Meir | A43B 1/04 66/170 |
| 2014/0082965 | A1 | 3/2014 | Greene et al. | |
| 2014/0150295 | A1 | 6/2014 | Dua et al. | |
| 2014/0245545 | A1 * | 9/2014 | Meir | A43B 23/0245 12/142 G |

FOREIGN PATENT DOCUMENTS

| | | | |
|---|---|---|---|
| CN | 102655776 | A | 9/2012 |
| EP | 1 437 057 | A1 | 7/2004 |
| WO | 2013/126313 | A2 | 8/2013 |

OTHER PUBLICATIONS

International Search Report and Written Opinion dated Aug. 11, 2014, issued in counterpart application No. PCT/EP2014/053641; with English partial translation and partial machine translation (25 pages).

* cited by examiner

METHOD FOR KNITTING A FOOTWEAR ELEMENT AND FOOTWEAR ELEMENT OBTAINED BY SUCH A METHOD

The invention relates to a method for producing a knitted footwear element, i.e. a method for knitting a footwear element, in particular a shoe element.

It is known to produce footwear elements, in particular shoes, from knitted parts. These methods require the knitted parts to be produced and then for their dimensions to be adjusted, in particular by cutting, before assembling said parts, for example by stitching or adhesive bonding. This series of steps poses problems. More specifically, they require significant amounts of time in order to be implemented. Moreover, the steps of adjusting the dimensions result in losses of unusable knitted fabric. Finally the seams, in particular the stitched seams, are liable to cause problems of discomfort for the wearer of the shoe.

The object of the invention is to provide a method for producing a knitted footwear element permitting the aforementioned drawbacks to be remedied and the methods known from the prior art to be improved. In particular, the invention proposes a method for producing a knitted footwear element which is simple, rapid and economical and which permits the losses of knitted fabric to be avoided and the comfort of the shoes to be improved for the wearer. In particular, the method makes it possible to avoid having to assemble, in particular to assemble by stitching or adhesive bonding, a tongue and an upper or an upper and a sole. Similarly, the parts of the upper and/or the parts of the sole do not have to be assembled by stitching or adhesive bonding when using such a method.

According to the invention the method comprises the knitting of a footwear element, in particular a shoe element, including:

a knitted upper, and
a knitted tongue, and
a knitted sole.

Preferably, this knitting is carried out continuously. By the term "continuously", it is preferably understood that the tongue-upper seam is partially knitted or entirely knitted and that the sole-upper seam is partially knitted or entirely knitted.

The knitted upper and the knitted tongue may be joined without stitching and the knitted upper and the knitted sole may be joined without stitching.

The seam or the transition from the knitted sole to the knitted upper may be at least partially, or even entirely, knitted or produced by knitting and the seam or the transition from the tongue to the upper is at least partially, or even entirely, knitted or produced by knitting.

It is possible to knit a first part of the footwear element including a first element of the upper and a first element of the tongue on a first bed of a knitting machine and it is possible to knit a second part of the footwear element including a second element of the upper and a second element of the tongue on a second bed of the knitting machine.

It is possible to knit a first part of the footwear element including a first element of the upper and a first element of the sole on a first bed of a knitting machine and it is possible to knit a second part of the footwear element including a second element of the upper and a second element of the sole on a second bed of the knitting machine.

It is possible to complete the knitting of the footwear element by positioning the needles of the two beds in a specific position, in particular a raised position, permitting the knitting of a yarn to be carried out simultaneously by the needles of the first and second beds.

It is possible to complete the knitting of the footwear element by knitting a thermoplastic yarn.

It is possible to knit at least one area surrounding an opening of the footwear element by successively forming one or more face stitches and one or more reverse stitches, the area including:

the tongue or a part of the tongue; and/or
an upper part of the upper.

The method may comprise a phase during which the upper and the tongue are knitted simultaneously, in particular knit loops of the upper and tongue are formed on the same row of knitting, in particular knit loops of an upper element and a tongue element are formed on a common row of knitting.

The method may comprise a phase during which successively the upper and the sole are knitted, in particular successively the knit loops of the upper are formed, then the knit loops of the sole, in particular successively the knit loops of an upper element are formed, then the knit loops of a sole element and/or the method may comprise a phase during which successively the knit loops of the tongue are knitted, then the knit loops of the upper, in particular successively the knit loops of a tongue element are formed, then the knit loops of an upper element.

According to the invention, a footwear element, in particular a shoe element, is obtained by implementing the method for knitting defined above.

According to the invention, a footwear element, in particular a shoe element, comprises:

a knitted upper, and
a knitted tongue, and
a knitted sole, at least one common first yarn being knitted at least in one part of the upper and at least in one part of the tongue, and/or at least one common second yarn being knitted at least in one part of the upper and at least in one part of the sole.

The first yarn and the second yarn may be a common yarn.

According to the invention, a footwear element, in particular a shoe element, comprises:

a knitted upper, and
a knitted tongue, and
a knitted sole, in particular the footwear element defined above, in which the seam or the transition from the knitted sole to the knitted upper is at least partially, or even entirely, knitted or produced by knitting and in which the seam or the transition from the tongue to the upper is at least partially, or even entirely, knitted or produced by knitting.

According to the invention, a shoe includes a footwear element as defined above.

The accompanying drawings show by way of example two embodiments of a method for producing a knitted footwear element according to the invention.

Figure 1:
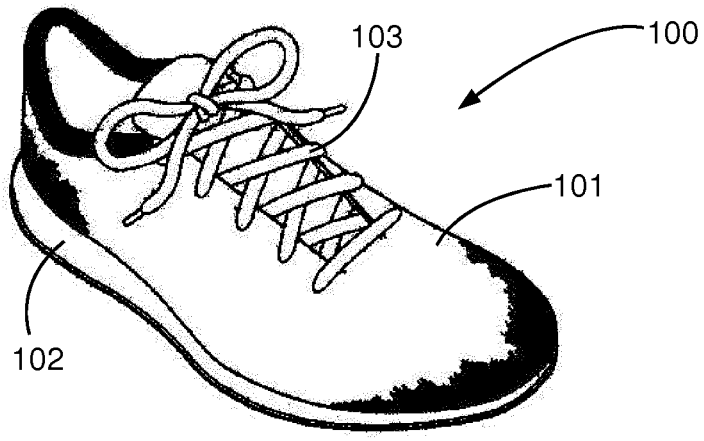
FIG. 1 is a perspective view of a shoe comprising a footwear element produced by implementing a method according to the invention.

An embodiment of a shoe 100 according to the invention is described hereinafter with reference to FIG. 1 which shows the shoe. This shoe is, for example, a sports shoe, in particular a shoe for athletics. The shoe principally comprises a footwear element 101, a sole 102 and a lace 103.

An embodiment of a footwear element 101 according to the invention is described hereinafter with reference to FIG. 2 which shows this footwear element. The footwear element includes a knitted upper 110, a knitted tongue 111 and a knitted sole 112, the sole not being visible in this figure. Moreover, this footwear element is characterized in that it is knitted in one step. Advantageously, the tongue and the upper are joined or assembled without stitching and without adhesive bonding. Similarly, the sole and the upper are advantageously joined or assembled without stitching and without adhesive bonding. In other words, the seam or the transition from the sole to the upper is at least partially knitted or produced by knitting. Similarly, the seam or the transition from the tongue to the upper is at least partially knitted or produced by knitting. Preferably, the seam or the transition from the sole to the upper is integrally knitted or produced by knitting. Similarly, the seam or the transition from the tongue to the upper is preferably integrally knitted or produced by knitting. Finally, the upper is not completed by a stitching or adhesive bonding operation and/or the sole is not completed by a stitching or adhesive bonding operation.

Preferably, at least one (continuous) common yarn makes it possible to knit at least one part of the upper and at least one part of the tongue and at least one (continuous) common yarn makes it possible to knit at least one part of the upper and at least one part of the sole. One common yarn may also permit at least one part of the upper and at least one part of the tongue and at least one part of the sole to be knitted.

Figure 2:
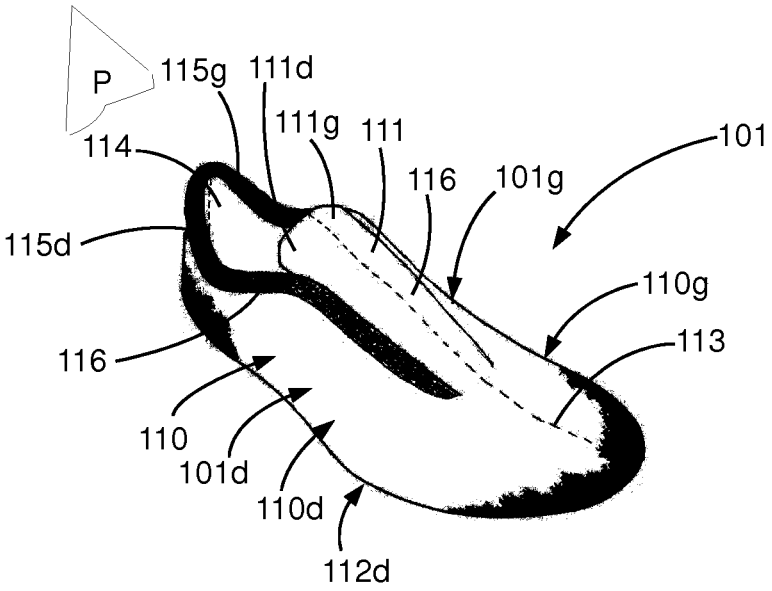
FIG. 2 is a perspective view of a footwear element produced by implementing the method according to the invention.

A plane P which is at least substantially vertical and at least substantially longitudinal and the outline 113 of this plane P on the footwear element are shown in FIG. 2. This plane may be replaced by any skew surface permitting a right-hand part 101*d* of the footwear element and a left-hand part 101*g* of the footwear element to be delimited, the right-hand part of the footwear element being knitted, in particular knitted integrally, on a first bed of a knitting machine and the left-hand part of the footwear element being knitted, in particular knitted integrally, on a second bed of the knitting machine.

Thus, the right-hand part of the footwear element comprises a first element 110*d* of the upper, a first element 111*d* of the tongue and a first element 112*d* of the sole and the left-hand part of the footwear element comprises a second element 110*g* of the upper, a second element of the tongue 111*g* and a second element 112*g* of the sole.

The tongue 111 comprises the first element 111*d* of the tongue and the second element 111*g* of the tongue, in particular the tongue is composed of these two elements.

The upper 110 comprises the first element 110*d* of the upper and the second element 110*g* of the upper, in particular the upper is composed of these two elements.

The sole 112 comprises the first element 112*d* of the sole and the second element 112*g* of the sole, in particular the sole is composed of these two elements.

The footwear element also comprises an opening 114 permitting the wearer to slip on the footwear element. This opening is partially sealed by the tongue 111.

Different areas of the footwear element, whether corresponding or not to the parts cited above, may be knitted with different yarns, in particular yarns of different sizes and/or yarns of different materials and/or yarns of different appearance, in particular different colors.

The footwear element comprises an area 116 in which the stitches are alternately or successively formed on the face and on the reverse. This area extends over the entire tongue or over a part of the tongue and/or over an upper part 115*d*, 115*g* of the upper, in particular around the opening or in the region of the opening. In this area, one or more face stitches and one or more reverse stitches are successively knitted. The successions of reverse stitches and face stitches may be produced on each or certain knitted row(s) and/or on each or on certain knitted column(s).

A successive reverse stitch and face stitch or successive reverse stitches and face stitches may also be produced on each or on certain knitted row(s) and/or on each or on certain knitted column(s) in any other location of the footwear element, in particular in any other location of the upper and/or the sole.

To produce the footwear element, naturally it is possible to use any type of knitted structure.

A first embodiment of the method according to the invention permitting a footwear element according to the invention to be produced is described hereinafter with reference to FIG. 3. In this figure, for example, the right-hand part of the footwear element is shown.

In a first step, rows of stitches or loops are knitted or formed from the segment extending between the points 201 and 202 to a segment extending between the points 203 and 204. This permits a tongue element 111*d* to be formed. This element is knitted on a first bed. However, a further complementary tongue element 111*g* is simultaneously knitted on a second bed, permitting the tongue 111 to be formed integrally. To achieve this, in the region of the segment 202-204, the knitting yarn passes or the knitting yarns pass from one bed to the other to form the tongue in one piece. To achieve this, means and methods are put in place to permit the yarns to change bed. As the size of the segment 201 to 206 is smaller than the size of the segment 202-204, a method for knitting is implemented which permits such a geometry to be obtained. This method is illustrated by the sketch in FIG. 6.

In a second step, rows of stitches or loops are knitted or formed from the curve extending between the points 205 and 206 to a curve extending between the points 207 and 210 via 211. However, a further complementary upper element 110*g* is simultaneously knitted on a second bed, permitting the upper 110 to be formed. To achieve this, in the region of the segment 205-207, the knitting yarn passes or the knitting yarns pass from one bed to the other to form the upper in one piece. To achieve this, means and methods are put in place to permit the yarns to change bed.

The seam following the segment 206-203 is produced by a method of the Intarsia type.

In these two first steps, the loops or stitches are successively formed on the face or reverse on each of the beds. Thus, a knitted area 116 is formed which does not tend to roll back onto itself. To achieve this, preferably the device disclosed in the published document of the international application WO2007/025400 is used.

In a third step, rows of stitches or loops are knitted or formed from the point 207 to the segment extending between the points 208 and 209. However, the other complementary upper element 110*g* is simultaneously knitted on a second bed, permitting the upper 110 to be formed. To achieve this, in the region of the segment 207-208, the knitting yarn passes or the knitting yarns pass from one bed to the other to form the upper in one piece. To achieve this, means and methods are put in place to permit the yarns to change bed.

In a fourth step, rows of stitches or loops are knitted or formed from the point 211 to the segment extending between the points 209 and 210. However, the other complementary upper element 110*g* is simultaneously knitted on a second bed, permitting the upper 110 to be formed.

The third and fourth steps may be carried out simultaneously.

In a fifth step, rows of stitches or loops are knitted or formed from the segment extending between the points 208 and 210 to the segment extending between the points 212 and 203. However, the other complementary upper element 110*g* is simultaneously knitted on a second bed, permitting the upper 110 to be formed. To achieve this, in the region of the segment 208-212 the knitting yarn passes or the knitting yarns pass from one bed to the other to form the upper in one piece. To achieve this, means and methods are put in place to permit the yarns to change bed.

In a sixth step, rows of stitches or loops are knitted or formed from the segment extending between the points 212 and 213 to the segment extending between the points 214 and 215. However, the other complementary upper element 110*g* is simultaneously knitted on a second bed, permitting the upper 110 to be formed. To achieve this, in the region of the segment 212-214 the knitting yarn passes or the knitting yarns pass from one bed to the other to form the upper in one piece. To achieve this, means and methods are put in place to permit the yarns to change bed.

In a seventh step, rows of stitches or loops are knitted or formed from the segment extending between the points 214 and 215 to the segment extending between the points 215 and 217. This method of knitting is, for example, of the reciprocating knitting type. However, the other complementary upper element 110*g* and the other sole element 112*g* are simultaneously knitted on a second bed, permitting the upper 110 and the sole 112 to be formed. To achieve this, in the region of the curve 214-217, the knitting yarn passes or the knitting yarns pass from one bed to the other to form the upper and the sole in one piece. To achieve this, means and methods are put in place to permit the yarns to change bed.

In an eighth step, rows of stitches or loops are knitted or formed from the segment extending between the points 213 and 217 to the segment extending between the points 203 and 218. However, the other complementary upper element 110*g* and the other sole element 112*g* are simultaneously knitted on a second bed, permitting the upper 110 and the sole 112 to be formed. In this eighth step, stitches left waiting in the region of the segment 213-203 during the fifth step are reused. In the region of the segment 217-218 the yarn passes from one bed to another. Progressing from left to right, the stitches are left waiting for subsequent use in a fourteenth step.

In a ninth step, rows of stitches or loops are knitted or formed from the segment extending between the points 218 and 203 to the segment extending between the points 219 and 204. However, the other complementary upper element 110*g* and the other sole element 112*g* are simultaneously knitted on a second bed, permitting the upper 110 and the sole 112 to be formed. To achieve this, in the region of the segment 218-219, the knitting yarn passes or the knitting yarns pass from one bed to the other to form the upper and the sole in one piece. To achieve this, means and methods are put in place to permit the yarns to change bed. In this ninth step, the stitches left waiting during the first step are reused and the knitting is joined to these stitches in the region of the segment 203-204. Thus, the tongue is joined to this knitted portion of the upper.

In a tenth step, rows of stitches or loops are knitted or formed from the segment extending between the points 219 and 204 to the segment extending between the points 229 and 220. However, the other complementary upper element 110*g* and the other sole element 112*g* are simultaneously knitted on a second bed, permitting the upper 110 and the sole 112 to be formed. To achieve this, in the region of the segment 204-220 and of the segment 219-229, the knitting yarn passes or the knitting yarns pass from one bed to the other to form the upper and the sole in one piece. To achieve this, means and methods are put in place to permit the yarns to change bed.

In an eleventh step, rows of stitches or loops are knitted or formed from the segment extending between the points 221 and 220 to the segment extending between the points 224 and 225. In the region of the line 221-224, the width of the knitting in this step is gradually reduced as it moves toward the front end of the footwear element. However, the other complementary upper element 110*g* is simultaneously knitted on a second bed, permitting the upper 110 to be formed. To achieve this, in the region of the segment 220-225, the knitting yarn passes or the knitting yarns pass from one bed to the other to form the upper in one piece. To achieve this, means and methods are put in place to permit the yarns to change bed.

In a twelfth step, rows of stitches or loops are knitted or formed from the segment extending between the points 224 and 225 to the segment extending between the points 224 and 227. This method of knitting is, for example, of the reciprocating knitting type. However, the other complementary upper element 110*g* is simultaneously knitted on a second bed, permitting the upper 110 to be formed. To achieve this, in the region of the curve 225-227, the knitting yarn passes or the knitting yarns pass from one bed to the other to form the upper in one piece. To achieve this, means and methods are put in place to permit the yarns to change bed.

In a thirteenth step, rows of stitches or loops are knitted or formed from the segment extending between the points 224 and 227 to the segment extending between the points 221 and 229. In the region of the line 221-224, the width of the knitting in this step is gradually increased as it moves away from the front end of the footwear element. However, the other complementary upper element 110*g* and the other complementary sole element 112*g* are simultaneously knitted on a second bed, permitting the upper 110 and the sole to be formed. To achieve this, in the region of the segment 227-229 the knitting yarn passes or the knitting yarns pass from one bed to the other to form the upper in one piece. To achieve this, means and methods are put in place to permit the yarns to change bed. In this thirteenth step, the stitches which are left waiting during the eleventh step are reused and the knitting is joined to these stitches in the region of the segment 221-224.

In a fourteenth step, rows of stitches or loops are knitted or formed from the segment extending between the points 221 and 229 to the point 228. However, the other complementary upper element 110*g* and the other complementary sole element 112*g* are simultaneously knitted on a second bed, permitting the upper 110 and the sole to be formed. In the region of the segment 221-228, the stitches are connected to the stitches left waiting at the end of the tenth step. In the region of the segment 221-229, the stitches are connected to the stitches of the preceding step.

Figure 7:
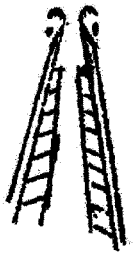
FIG. 7 is an illustration of a conventional position of needles of two beds advantageously used in the method of the invention.
Figure 8:
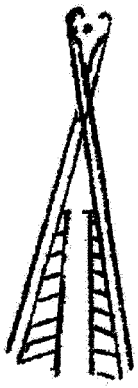
FIG. 8 is an illustration of a specific position of needles of two beds advantageously used in the method of the invention.

Whilst the needles of the two beds are preferably used in their positions illustrated in FIG. 7 in the first to fourteenth steps, in a fifteenth step, needles of the first and second beds are placed in a raised position illustrated in FIG. 8. Thus, rows of stitches or loops are knitted or formed according to the segment 217-219, by reusing the stitches left waiting in the preceding steps and by joining the knitting to these stitches. Preferably a yarn made of thermoplastic material, for example PVC, is used. Thus, the sole elements 112*d* and 112*g* formed above are joined and the lower part of the footwear element is closed.

Figure 3:
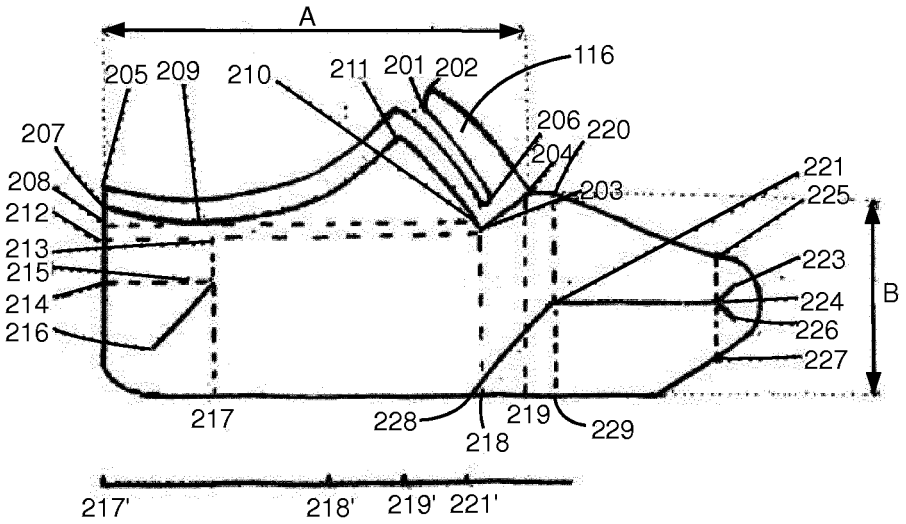
FIG. 3 is a schematic view from the side of a footwear element illustrating a first embodiment of the method according to the invention.

In FIG. 3, the points 217', 218', 219' and 221' show the positions of the points 217, 218, 219 and 221 on the beds.

The footwear element of FIG. 3 may also be produced on a circular knitting machine. The stitches of the line 217-219 thus remain on the needles and are then joined together by using a yarn, in particular on a machine such as a sewing machine. In the case of knitting in the region of the segment 217-219, the dimensions of the footwear element may be obtained using knitted structures which are non-uniform.

Figure 4:
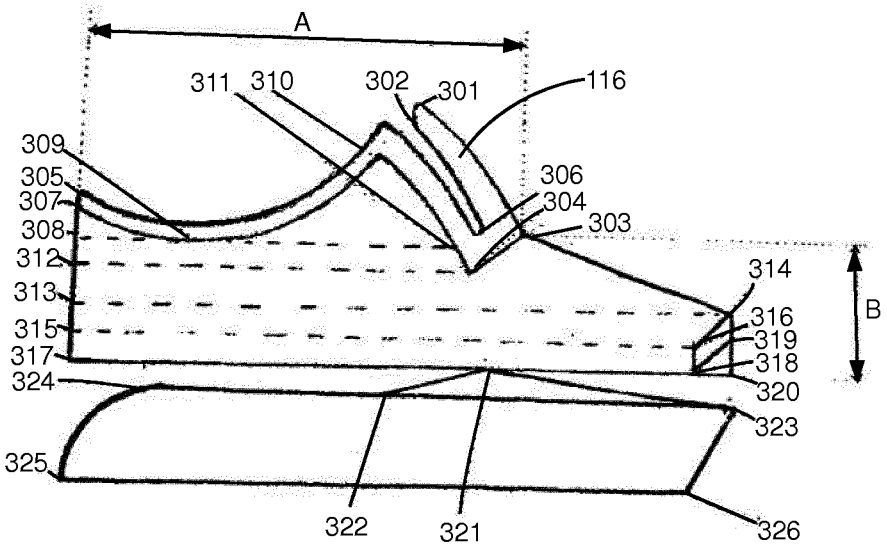
FIG. 4 is a schematic view from the side of a footwear element illustrating a second embodiment of the method according to the invention.

A second embodiment of the method according to the invention permitting a footwear element to be produced according to the invention is described hereinafter with reference to FIG. 4. The right-hand part of the footwear element is shown, for example, in this figure.

Figure 6:
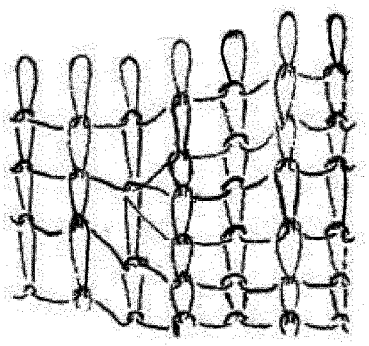
FIG. 6 is an illustration of a method permitting an enlargement of a size of a knitted fabric belonging to the group of double jersey knits.

In a first step, rows of stitches or loops are knitted or formed from the segment extending between the points 301 and 302 to a segment extending between the points 303 and 304. This makes it possible to form a tongue element 111*d*. This element is knitted on a first bed. However, a further complementary tongue element 111*g* is simultaneously knitted on a second bed, permitting the tongue to be formed integrally 111. To achieve this, in the region of the segment 301-304, the knitting yarn passes or the knitting yarns pass from one bed to the other to form the tongue in one piece. To achieve this, means and methods are put in place to permit the yarns to change bed. As the size of the segment 301 to 304 is greater than the size of the segment 302-303, a method for knitting is used which permits such a geometry to be obtained. This method is illustrated by the sketches of FIG. 6.

In a second step, rows of stitches or loops are knitted or formed from the curve extending between the points 305 and 306 to a curve extending between the points 307 and 311 via 310. However, a further complementary upper element 110*g* is simultaneously knitted on a second bed, permitting the upper 110 to be formed. To achieve this, in the region of the segment 305-307, the knitting yarn passes or the knitting yarns pass from one bed to the other to form the upper in one piece. To achieve this, means and methods are put in place to permit the yarns to change bed.

The seam along the segment 306-303 is produced by a method of the Intarsia type.

In these two first steps, the loops or stitches are formed successively on the face and on the reverse on each of the beds. Thus, a knitted area 116 is formed which does not tend to roll back onto itself. To achieve this, the device described in the published document of the international application WO2007/025400 is preferably used.

In a third step, rows of stitches or loops are knitted or formed from the point 307 to the segment extending between the points 308 and 309. However, the other complementary upper element 110*g* is simultaneously knitted on a second bed, permitting the upper 110 to be formed. To achieve this, in the region of the segment 307-308, the knitting yarn passes or the knitting yarns pass from one bed to the other to form the upper in one piece. To achieve this, means and methods are put in place to permit the yarns to change bed.

In a fourth step, rows of stitches or loops are knitted or formed from the point 310 to the segment extending between the points 309 and 311. However, the other complementary upper element 110*g* is simultaneously knitted on a second bed, permitting the upper 110 to be formed.

The third and fourth steps may be implemented simultaneously.

In a fifth step, rows of stitches or loops are knitted or formed from the segment extending between the points 308 and 311 to the segment extending between the points 312 and 303. However, the other complementary upper element 110*g* is simultaneously knitted on a second bed, permitting the upper 110 to be formed. To achieve this, in the region of the segment 308-312, the knitting yarn passes or the knitting yarns pass from one bed to the other to form the upper in one piece. To achieve this, means and methods are put in place to permit the yarns to change bed.

In a sixth step, rows of stitches or loops are knitted or formed from the point 304 to the segment extending between the points 313 and 314. However, the other complementary upper element 110*g* is simultaneously knitted on a second bed, permitting the upper 110 to be formed. To achieve this, in the region of the segment 304-314, the knitting yarn passes or the knitting yarns pass from one bed to the other to form the upper in one piece. To achieve this, means and methods are put in place to permit the yarns to change bed. In this step, in the region of the segment 312-304, stitches left waiting at the previous step are reused and the knitting is joined to these stitches. In the region of the segment 303-304, the tongue is joined to the knitting of the upper.

In a seventh step, rows of stitches or loops are knitted or formed from the segment extending between the points 313 and 314 to the segment extending between the points 315 and 316. However, the other complementary upper element 110*g* is simultaneously knitted on a second bed, permitting the upper 110 to be formed. To achieve this, in the region of the segment 313-315, the knitting yarn passes or the knitting yarns pass from one bed to the other to form the upper in one piece. To achieve this, means and methods are put in place to permit the yarns to change bed.

In an eighth step, rows of stitches or loops are knitted or formed from the segment extending between the points 315 and 314 via the point 316 to the segment extending between the points 317 and 319, via the point 318. However, the other complementary upper element 110*g* is simultaneously knitted on a second bed, permitting the upper 110 to be formed. To achieve this, in the region of the segments 315-317 and 314-319, the knitting yarn passes or the knitting yarns pass from one bed to the other to form the upper in one piece. To achieve this, means and methods are put in place to permit the yarns to change bed. In this eighth step, the stitches left waiting in the region of the segment 314-316 during the preceding step are reused and the knitting is joined to these stitches.

In a ninth step, rows of stitches or loops are knitted or formed from the point 319 to the segment extending between the points 318 and 320. However, the other complementary upper element 110*g* is simultaneously knitted on a second bed, permitting the upper 110 to be formed. To achieve this, in the region of the segment 319-320 the knitting yarn passes or the knitting yarns pass from one bed to the other to form the upper and the sole in one piece. To achieve this, means and methods are put in place to permit the yarns to change bed. In this ninth step, the stitches left waiting in the region of the segment 319-318 during the previous step are reused.

In a tenth step, the rows of stitches or loops are knitted or formed from the point 321 to the segment extending between the points 322 and 323. However, the other complementary sole element 112*g* is simultaneously knitted on a second bed, permitting the sole 112 to be formed. In this tenth step, the stitches left waiting in the region of the segment 317-318-320 during the two preceding steps are reused.

In an eleventh step, rows of stitches or loops are knitted or formed from the segment extending between the points 324 and 323 via the point 322 to the segment extending between the points 325 and 326. However, the other complementary sole element 112*g* is simultaneously knitted on a second bed, permitting the sole 112 to be formed. To achieve this, in the region of the segment 323-326 and in the region of the curve 324-325, the knitting yarn passes or the knitting yarns pass from one bed to the other to form the sole in one piece. To achieve this, means and methods are put in place to permit the yarns to change bed. In this eleventh step, the stitches left waiting in the region of the segment 317-320 during the ninth step are reused.

Whilst the needles of the two beds are preferably used in their positions illustrated in FIG. 7 in the first to eleventh steps, in a twelfth step, the needles of the first and second beds are placed in a raised position illustrated in FIG. 8. Thus, stitches or loops are knitted or formed according to the segment 325-323, reusing the stitches left waiting in the previous step. Also, a knitted seam is produced with the stitches of the segment 323-326. Preferably, a yarn made of thermoplastic material is used, such as for example PVC. Thus, the sole elements 112*d* and 112*g* formed previously are joined and the lower part of the footwear element is closed.

The first to the fourteenth steps of the first embodiment and the first to the eleventh steps of the second embodiment are preferably implemented by using yarn made of material, such as for example natural cotton yarn, synthetic yarn, synthetic yarn with an anti-bacterial additive and/or an additive improving the sensation of comfort.

Figure 5:
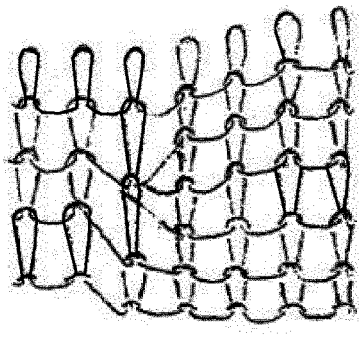
FIG. 5 is an illustration of a method permitting an enlargement of a size of a knitted fabric belonging to the group of single jersey knits.

Advantageously, it is understood that the right-hand and left-hand parts of the footwear element are knitted in a symmetrical non-geometric manner so as to take into account the asymmetries of the feet of the wearers. These asymmetries are generated, for example, by using knitted structures such as those shown in FIGS. 5 and 6.

The knitting process advantageously permits patterns and decorative elements to be produced on the footwear element, in particular by using yarns of different colors, or more generally different appearances. The use of a plurality of knitted yarns successively or simultaneously also enables different features to be obtained on the footwear element.

Once the footwear element is made, in order to produce a shoe, a sole 102 may be attached below the footwear element, for example the sole may be attached by stitching and/or adhesive bonding. It is also possible to attach eyelets for laces and a lace 103. The eyelets may also be formed by knitting, in particular by knitting the upper.

To produce the shoe, it is also possible to attach a plastic film to the knitted footwear element.

The method for knitting according to the invention may be implemented by using a device for selectively knitting reverse stitches and face stitches, using needles of a common bed 3 comprising a plurality of parallel guide grooves 4 in which the needles 1, 2 are slidably mounted, each of these guide grooves 4 receiving a double composite needle 1, 2 comprising two hooks 5, 6 which are open at the side and respectively formed through the first ends of two planar shanks, one thereof, the internal shank 1*a*-1*c*, being adjacent to the bottom of the guide groove 4 and the other thereof, the external shank 2*a*-2*c*, being coplanar and adjacent to the internal shank 1*a*-1*c*. The device comprises means 10, 11 for placing the second end of each of said shanks 1*a*-1*c* 2*a*-2*c* selectively in engagement with two control means 12-15 for knitting a face stitch, respectively a reverse stitch, the terminal portion of the first end of the external shank 2*a*-2*c* forming a sliding ramp for a stitch 7 with an acute angle at its portion adjacent to the internal needle 1. Each double needle 1, 2 is associated with two adjacent jacks 18, 19, one 18 to form a loop or to retain a stitch and the other 19 to release said loop, each of these jacks being associated with means 24, 27 for selective engagement with the control means.

Figure 9:
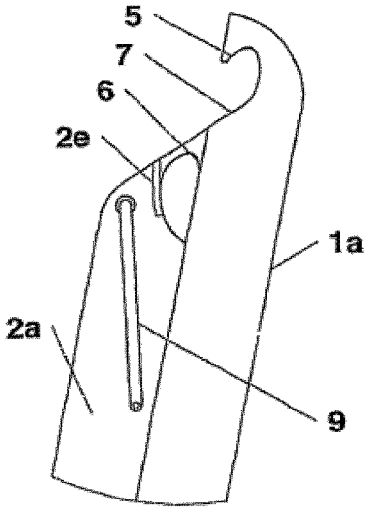
FIGS. 9 and 10 are views from the side in elevation of a knitting needle of a knitting device which is able to be used to implement the method according to the invention.
Figure 10:
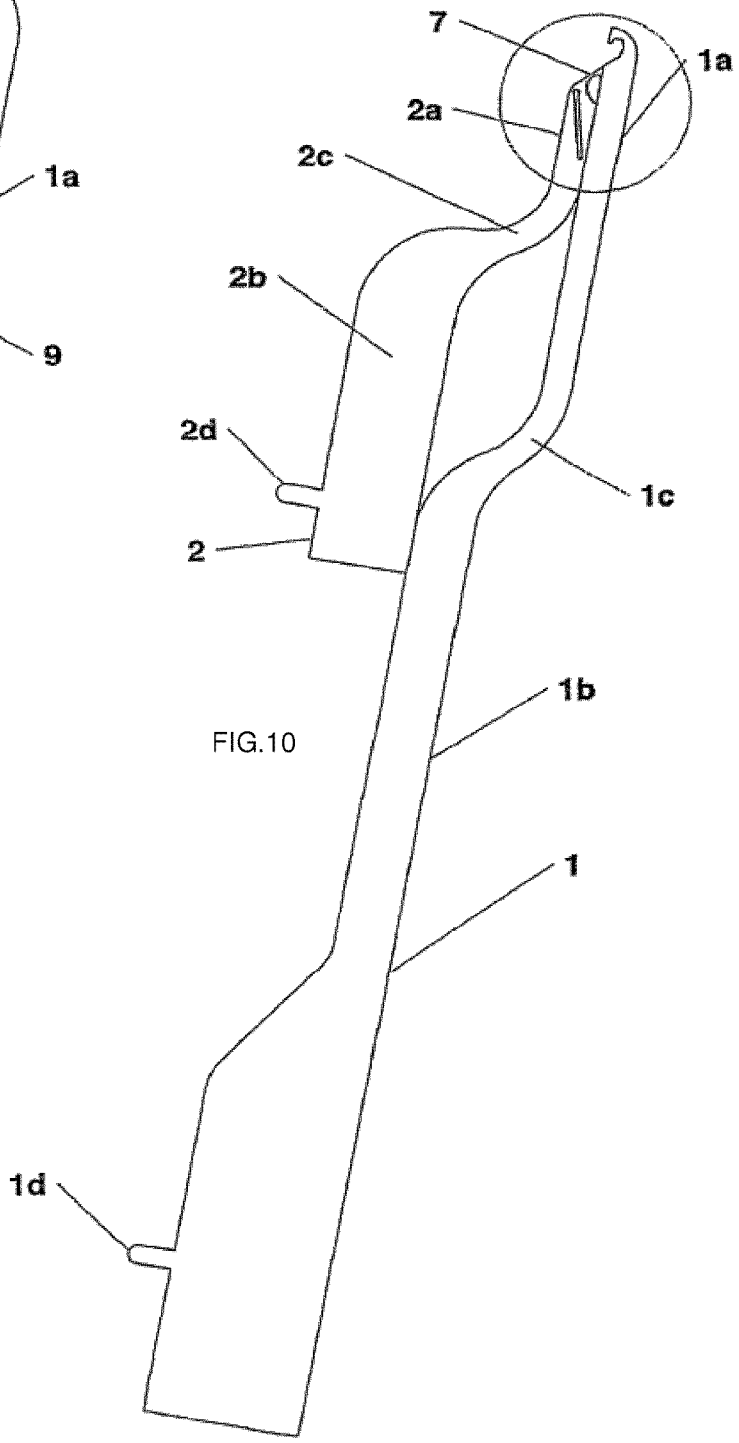
Figure 11:
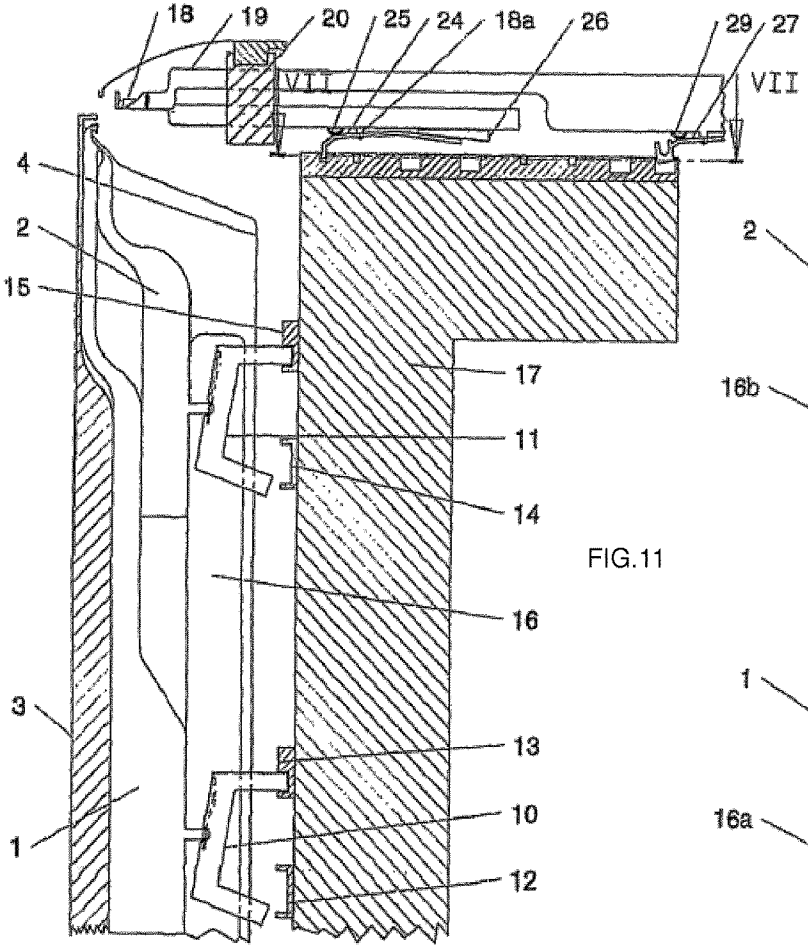
FIG. 11 is a sectional view of this knitting device, perpendicular to the bed in a first knitting position.

FIGS. 9 and 10 illustrate a double composite needle forming part of the device for selectively knitting face stitches and reverse stitches. This double needle comprises a first needle 1 and a second needle 2. These two needles 1 and 2 are elongated and formed by two planar shanks mounted in a coplanar manner in one of the conventional parallel guide grooves 4 of a bed 3 of a knitting machine as illustrated by FIG. 11. The shank of the needle 1 is mounted in the bottom of the guide groove 4 and is the internal shank, whilst the shank of the second needle 2 which slides on the shank of the first needle 1 is the external shank. In the case of the present invention, however, the guide grooves are deeper than normal, to ensure the guidance of the double needle.

The upper end or first end of each needle shank 1, 2 is terminated by a hook 5, respectively 6. In the embodiment shown, the two hooks 5, 6 face one another. When they are located in the relative positions illustrated by FIG. 9, the base of the hook 5 of the internal shank forms with the terminal portion of the first end of the external shank 2 a sliding ramp 7 for the stitch.

The needle shank 2 has on one of its faces and in the vicinity of its first end, a separator element 9 to separate the yarn loop from the shank of the needle, the purpose thereof being explained below. This separator element 9 is formed by a spring wire fixed at one of its ends, the other end thereof being able to penetrate a hole which passes through the shank of the needle 2.

Each needle shank 1, 2 comprises two parallel parts 1*a*, 1*b*, respectively 2*a*, 2*b*, connected together by a double bend 1*c*, respectively 2*c*. The purpose of this is to create an upper part of the bed which is sufficiently narrow to reduce the spacing between the bed of needles of this bed with the bed of needles of the parallel bed (not shown) in the case of the formation of a tubular knit, in order to obtain a transition which is barely visible between the webs knitted on the two beds.

Figure 12:
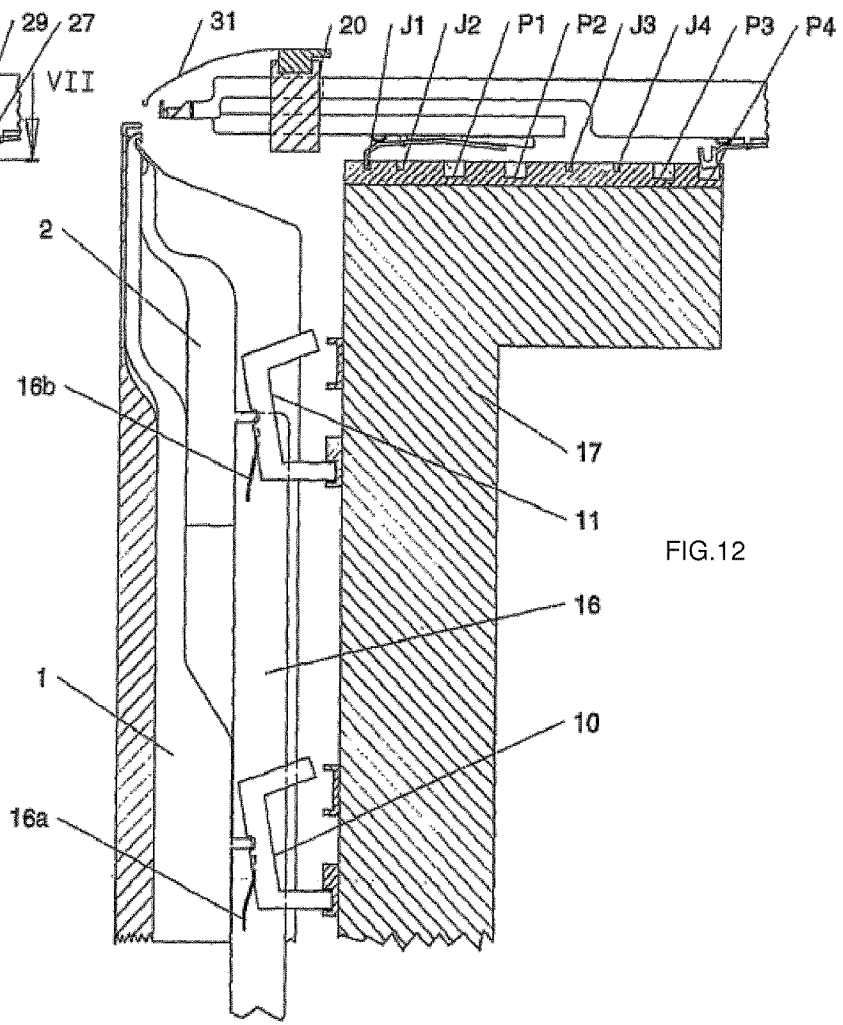
FIG. 12 is a view similar to FIG. 11 in a further knitting position.

At their second respective ends, the shanks 1, 2 each have a projection 1*d*, respectively 2*d*, an actuator 10, respectively 11, being mounted on each projection in an oscillating manner in the plane of the guide groove 4. Each actuator 10, 11 comprises two arms, each designed to come alternately into engagement with two control cams 12, 13, respectively 14, 15, of the needles 1, 2. These cams 12-15 are fixed to a carriage 17 associated with usual drive means (not shown) to be displaced in a direction perpendicular to the cutting plane of FIGS. 11 and 12. A selector 16 slidably mounted in the guide groove 4 has two grooves in the form of cams 16*a*, 16*b* (FIG. 12), each in engagement with a pin protruding laterally from each of the actuators 10, 11. The selector 16 is displaced between its two positions illustrated by FIGS. 11 and 12 by a selection mechanism (not shown) thus placing the arms of the actuators alternately in engagement with the cams 13 and 15, respectively 12 and 14, according to whether it is desired to knit face stitches or reverse stitches.

The knitting device according to the invention further comprises a pair of jacks, one thereof 18 being the principal jack and the other 19 thereof being the auxiliary jack formed by two adjacent plates. Each pair of jacks is associated with each double composite needle 1, 2. The principal jack 18 is adjacent to one of the two large faces of the double needle 1, 2 and passes to the right thereof when the bed 3 is viewed from the side of the needles 1, 2. One of the two large faces of the auxiliary jack 19 is applied against one of the large faces of the principal jack 18. At its front end, the auxiliary jack 19 has a part 19*c* separated from the adjacent face of the principal jack 18, whilst remaining parallel to this adjacent face. At the same time, the width of the auxiliary jack 19 reduces as it passes toward its front end forming a ramp 19*d*. At its front end, the auxiliary jack 19 comes back into contact with the adjacent face of the principal jack 18. This parallel part 19*c* is connected to the plate of the auxiliary jack 19, respectively at its front end, by two parts 19*e* which are inclined relative to the plane of the plate. This part 19*c* of the auxiliary jack thus forms a channel designed to permit the passage of the internal needle 1, as will be seen below.

Preferably, in order to implement the invention a knitting device is used on each of two beds of a knitting apparatus, as disclosed above.

The invention claimed is:

1. A footwear element comprising:

a knitted upper, a knitted tongue, and a knitted sole, wherein the upper, tongue and sole include continuous knitting, wherein the tongue is formed by a panel having free lateral edges between a free top edge and a base of the tongue, the panel including knitted courses or wales of stitches or loops whose ends form the free lateral edges of the panel between the free top edge and the base of the tongue, and wherein a transition from the tongue to the upper is at least partially continuously knitted or produced by continuous knitting.

2. A The footwear element comprising:

as claimed in claim 1, wherein at least one selected from the group consisting of (i) at least one common first yarn is knitted at least in one part of the upper and at least in one part of the tongue, and (ii) at least one common second yarn is knitted at least in one part of the upper and at least in one part of the sole.

3. The footwear element as claimed in claim 2, wherein the first yarn and the second yarn are a common yarn.

4. A footwear element comprising:

a knitted upper, a knitted tongue, and a knitted sole, wherein the tongue is formed b a panel having free lateral edges between a free top edge and a base of the tongue, the panel including knitted courses or wales of stitches or loops whose ends form the free lateral edges of the panel between the free top edge and the base of the tongue, and wherein (i) a seam or a transition from the knitted sole to the knitted upper is at least partially knitted or produced by knitting and (ii) a seam or a transition from the base of the tongue to the upper is at least partially knitted or produced by knitting.

5. A shoe including a footwear element as claimed in claim 1.

6. A method for knitting continuously a footwear element, including knitting continuously:

a knitted upper, and a knitted tongue, and a knitted sole, so as to form the footwear element according to claim 1.

7. The method for knitting as claimed in claim 6, wherein the knitted upper and the knitted tongue are joined without stitching and wherein the knitted upper and the knitted sole are joined without stitching.

8. The method for knitting as claimed in claim 6, wherein a seam or a transition from the knitted sole to the knitted upper is at least partially knitted or produced by knitting and wherein a seam or a transition from the tongue to the upper is at least partially knitted or produced by knitting.

9. The method for knitting as claimed in claim 6, wherein a first part of the footwear element including a first element of the upper and a first element of the tongue is knitted on a first bed of a knitting machine, and a second part of the footwear element including a second element of the upper and a second element of the tongue is knitted on a second bed of the knitting machine.

10. The method for knitting as claimed in claim 6, wherein a first part of the footwear element including a first element of the upper and a first element of the sole is knitted on a first bed of a knitting machine and a second part of the footwear element including a second element of the upper and a second element of the sole is knitted on a second bed of the knitting machine.

11. The method for knitting as claimed in claim 9, wherein the knitting of the footwear element is completed by positioning needles of the first and second beds in a specific position permitting the knitting of a yarn to be carried out simultaneously by the needles of the first and second beds.

12. The method for knitting as claimed in claim 6, wherein the knitting of the footwear element is completed by knitting a thermoplastic yarn.

13. The method for knitting as claimed in claim 6, wherein at least one area surrounding an opening of the footwear element is knitted by successively forming one or more face stitches and one or more reverse stitches, the area including at least one selected from the group consisting of:

the tongue or a part of the tongue; and an upper part of the upper.

14. The method for knitting as claimed in claim 6, comprising a phase during which the upper and the tongue are knitted simultaneously.

15. The method for knitting as claimed in claim 6, comprising at least one selected from the group consisting of (i) a phase during which successively the upper and the sole are knitted, and (ii) a phase during which successively the knit loops of the tongue are knitted, then the knit loops of the upper.

16. The method for knitting as claimed in claim 6, comprising using a device for selectively knitting reverse stitches and face stitches, using needles of a common bed comprising a plurality of parallel guide grooves in which the needles are slidably mounted, wherein, in the device, each of the guide grooves receives a composite double needle comprising two hooks which are open laterally, and respectively formed through first ends of two planar shanks, one thereof, the internal shank, being adjacent to a bottom of the guide groove, and the other thereof, the external shank, being coplanar and adjacent to the internal shank, the device comprising means for placing the second end of each of said shanks selectively in engagement with two control means for knitting a face stitch, respectively a reverse stitch, the terminal portion of the first end of the external shank forming a sliding ramp for a stitch with an acute angle at a portion thereof adjacent to an internal needle of the double needle, and the device being configured so that each double needle is associated with two adjacent jacks, one of the jacks being adapted to form a loop or to retain a stitch and the other of the jacks being adapted to release said loop, each of said jacks being associated with means for being selectively placed in engagement with the control means.

17. The method for knitting as claimed in claim 14, wherein knit loops of the upper and of the tongue are formed on a common row of knitting.

18. The method of knitting as claimed in claim 17, wherein knit loops of an upper element and of a tongue element are formed on a common row of knitting.

19. The method for knitting as claimed in claim 15, comprising a phase during which successively the upper and the sole are knitted, wherein, successively, the knit loops of the upper are formed, then knit loops of the sole are formed.

20. The method for knitting as claimed in claim 19, comprising a phase during which successively the knit loops of the tongue are knitted, then the knit loops of the upper, wherein, successively, the knit loops of a tongue element are formed, then the knit loops of an upper element are formed.

* * * * *